US012152840B2

(12) United States Patent
Jeanningros et al.

(10) Patent No.: US 12,152,840 B2
(45) Date of Patent: Nov. 26, 2024

(54) HEAT EXCHANGER MODULE OF THE TYPE HAVING PLATES COMPRISING CHANNELS INCORPORATING AT LEAST ONE FLUID SUPPLY AND DISTRIBUTION ZONE FORMED BY STUDS

(71) Applicant: COMMISSARIAT A L'ENERGIE ATOMIQUE ET AUX ENERGIES ALTERNATIVES, Paris (FR)

(72) Inventors: Xavier Jeanningros, Pierrevert (FR); Julien Grosse, Mures (FR); Julien Serre, Ginasservis (FR); Sébastien Vincent, Vinon sur Verdon (FR); Lionel Cachon, Manosque (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 126 days.

(21) Appl. No.: 17/661,574

(22) Filed: May 2, 2022

(65) Prior Publication Data

US 2022/0357110 A1 Nov. 10, 2022

(30) Foreign Application Priority Data

May 6, 2021 (FR) ..... 21 04813

(51) Int. Cl.
*F28F 9/02* (2006.01)
*F28D 9/00* (2006.01)

(52) U.S. Cl.
CPC ..... *F28D 9/0043* (2013.01); *F28D 9/0037* (2013.01); *F28D 9/005* (2013.01);
(Continued)

(58) Field of Classification Search
CPC ..... F28D 9/0037; F28D 9/005; F28F 9/0217; F28F 2275/04; F28F 2275/061; F28F 2275/062; F28F 3/044
See application file for complete search history.

(56) References Cited

U.S. PATENT DOCUMENTS 10,002,682 B2 6/2018 Fribourg
2012/0118548 A1 5/2012 Han et al.
(Continued)

FOREIGN PATENT DOCUMENTS

EP 1 936 311 A1 6/2008
EP 2607830 B1 * 9/2018 ..... F28D 9/0043
(Continued)

OTHER PUBLICATIONS

Preliminary French Search Report issued Nov. 29, 2021 in French Application 21 04813 filed on May 6, 2021, 3 pages (with English Translation of Categories of Cited Documents).
(Continued)

*Primary Examiner* — Devon Russell
(74) *Attorney, Agent, or Firm* — Oblon, McClelland, Maier & Neustadt, L.L.P.

(57) ABSTRACT

A heat exchanger module having at least two fluid circuits, of longitudinal axis including a stack of plates, defining at least two fluid circuits, at least a part of the plates each including fluid circulation channels, the channels of at least one of the two circuits, referred to as first circuit, having at least one fluid supply and distribution zone for supplying and distributing fluid from outside the stack, forming a fluid pre-header, in which zone the channels are delimited by studs distributed over the surface of the plate; an exchange zone continuous with the pre-header and wherein the channels are each delimited by a groove separated from one another by a rib and extending along the longitudinal axis.

19 Claims, 18 Drawing Sheets

(52) U.S. Cl.
CPC ..... *F28F 9/0217* (2013.01); *F28F 2275/04* (2013.01); *F28F 2275/061* (2013.01); *F28F 2275/062* (2013.01)

(56) References Cited

U.S. PATENT DOCUMENTS

| | | | | |
|---|---|---|---|---|
| 2015/0146838 | A1* | 5/2015 | Fribourg | G21C 15/22 376/298 |
| 2020/0049413 | A1* | 2/2020 | Ojiro | F28D 9/0056 |

FOREIGN PATENT DOCUMENTS

| | | | | |
|---|---|---|---|---|
| FR | 2 866 699 | B1 | 6/2008 | |
| FR | 3 054 879 | B1 | 8/2018 | |
| FR | 3099564 | A1 * | 2/2021 | F28D 9/0006 |
| GB | 1468514 | A * | 3/1977 | F28F 3/044 |
| JP | 2002-277089 | A | 9/2002 | |
| JP | 2005-188888 | A | 7/2005 | |
| JP | 2016-529469 | A | 9/2016 | |
| KR | 10-2007-0061448 | A | 6/2007 | |
| KR | 10-2019-0009974 | A | 1/2019 | |
| WO | WO 2015/028923 | A1 | 3/2015 | |
| WO | WO-2020100276 | A1 * | 5/2020 | F24D 17/02 |
| WO | WO-2020234056 | A1 * | 11/2020 | F28D 9/005 |

OTHER PUBLICATIONS

Plancq et al., "Status of the astrid gas power conversion system option", GIF Symposium 2018, The Generation IV International Forum, Oct. 2018, 10 pages, HAL Id: cea-02338590, https://hat.cea.archives-ouvertes.fr/cea-02338590.

Office Action issued Jan. 19, 2024, in corresponding Korean Patent Application No. 10-2022-0054910 (with English Translation), 15 pages.

* cited by examiner

[Fig 13]
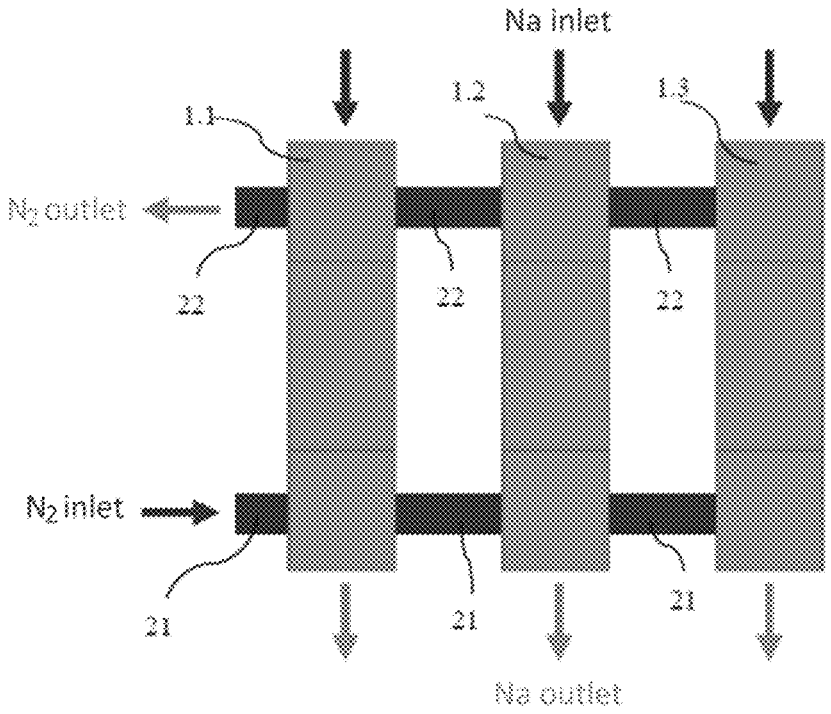
[Fig 14]
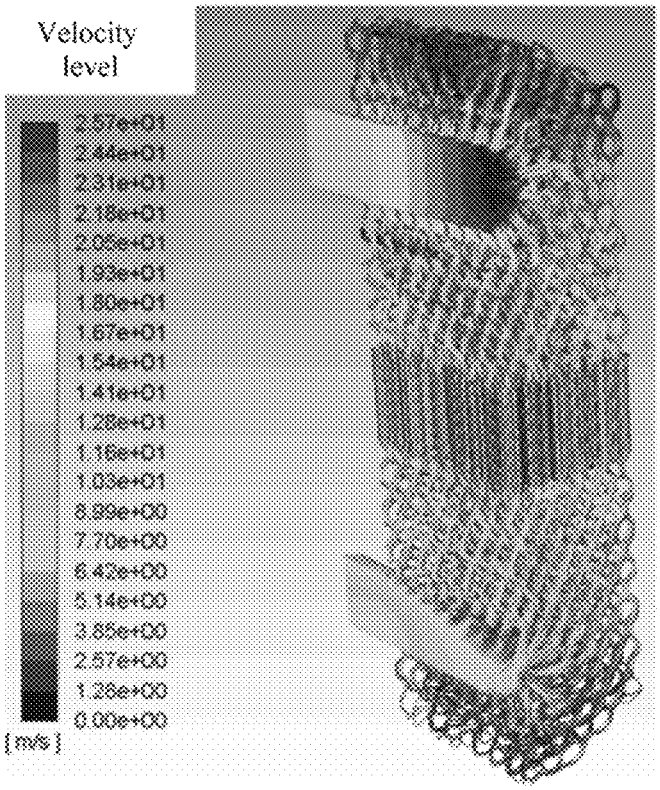

HEAT EXCHANGER MODULE OF THE TYPE HAVING PLATES COMPRISING CHANNELS INCORPORATING AT LEAST ONE FLUID SUPPLY AND DISTRIBUTION ZONE FORMED BY STUDS

TECHNICAL FIELD

The present invention relates to a heat exchanger module with a stack of metal plates, incorporating at least two fluid circuits.

The invention relates more particularly to the creation of a normal type of heat exchanger module for improving the uniformity of the distribution of the various internal fluid circulation channels while at the same time ensuring good thermal efficiency and satisfactory thermal mechanical loading, and doing so without detriment to the compactness of the module.

Known heat exchangers comprise either at least two circuits with internal fluid circulation channels. In exchangers having one single circuit, the exchangers of heat are performed between the circuit and a surround fluid in which it is immersed. In exchangers having at least two fluid circuits, the exchanges of heat are between the two fluid circuits.

Chemical reactors which perform a continuous process whereby a small quantity of coreactants are injected simultaneously at the inlet of a first fluid circuit, preferably fitted with a mixer, and the chemical product obtained is recovered at the outlet of said first circuit are known. Of these known chemical reactors, some comprise a second fluid circuit, often referred to as a utility circuit and the function of which is to thermally control the chemical reaction either by supplying the heat necessary for the reaction or, on the other hand, by removing the heat released thereby. Such chemical reactors with two fluid circuits with a utility are often referred to as exchanger-reactors.

The present invention relates to the creation of heat exchanger modules with a heat exchange function alone and which incorporate two fluid circuits, and equally relates to the creation of exchanger reactors. Thus, in the context of the invention, a "heat exchanger module with at least two fluid circuits" is to be understood as meaning a heat exchanger module with a heat exchange function alone, or equally an exchanger reactor.

The main use of an exchanger module exchanging between two fluids according to the invention is the use thereof with a gas as one of the two fluids. This may advantageously be a liquid metal and a gas, for example liquid sodium and nitrogen.

The main application for which an exchanger module according to the invention is intended is the exchange of het between a liquid metal, such as liquid sodium, from the secondary loop, and nitrogen as the gas of the tertiary loop of a liquid metal cooled fast neutron reactor such as a sodium fast reactor SFR or Na-cooled FNR, and which forms part of the so-called fourth-generation family of reactors.

A heat exchange module according to the invention may also be implemented in any other application requiring an exchange between two fluids, such as a liquid and a gas, preferably when it is necessary to have an exchanger that is compact with high thermal power.

In the context of the invention a "primary fluid" has its usual meaning in thermodynamics, namely is the hot fluid that transfers its heat to the secondary fluid which is the cold fluid.

By contrast, in the context of the invention, a "secondary fluid" has the usual meaning in thermodynamics, being namely the cold fluid to which the heat of the primary fluid is transferred.

In the main application, the primary fluid is the sodium circulating in the so-called secondary loop of the thermal conversion cycle of an SFR, while the secondary fluid is the nitrogen circulating in the tertiary loop of said cycle.

PRIOR ART

Known tube exchangers are, for example, shell and tube exchangers in which a bundle of straight or U-bent or helically wound tubes is fixed to pierced plates and placed inside a fluid tight enclosure known as a shell. In these shell and tube exchangers, one of the fluids circulates insides the tubes while the other fluid circulates inside the shell. These shell tube exchangers have a large volume and are therefore not at all compact.

Existing so-called plate heat exchanges offer significant advantages over the existing so-called tube exchangers, particularly in terms of their thermal performance and compactness thanks to a favorably high heat exchange surface area to volume ratio. Compact plate exchangers are used in numerous fields of industry. In this field of compact plate exchangers, numerous elementary shapes defining heat exchange patterns have been developed.

Mention may be made first of all of plate exchangers incorporating fins, in which a heat exchange pattern is defined by a structure delimited by fins, the structures being attached between two metal plates and able to have very varying geometries. The exchange pattern may differ between one of the two fluid circuits of the exchanger and the other. Assembly between metal plates is usually by brazing or by diffusion welding.

Wavy or corrugated plate exchangers are also known. The wavy corrugations are created by pressing a sheet separating the two fluid circuits. As a result, the exchanger pattern is the same for each of the two fluid circuits.

The fluid flow generated by this type of exchange pattern is three dimensional and, as a result, performs very well. Assembly between plates is either by bolted connection or by peripheral welding (conventional welding or diffusion welding).

Finally, plate exchangers with machined grooves are known, the machining being mechanical or electrochemical machining. The channels defined by the machining operations have a millimeter-scale cross section and are usually continuous with a uniform zigzag profile. The plates are assembled by diffusion welding allowing welding at all the points of contact between two adjacent plates. This type of machined grooved plate exchanger is therefore intrinsically very able to withstand pressure.

Some of the inventors of the present invention have designed an exchanger with modules of stacked plates for the exchange of heat between a gas and a liquid metal in the context of the creation of a nuclear reactor of the so-called fourth-generation family of reactors, namely in a configuration for exchange of heat between an excellent heat transfer fluid, the liquid metal, typically liquid sodium (Na) and a fluid having significantly inferior heat transfer properties, the gas, typically nitrogen ($N_2$).

Patent Application WO2015/028923 A1 thus describes and claims a heat exchanger wherein the heat exchange modules are arranged inside and fixed rigidly to a pressure vessel by the pressure of the gas, typically at approximately 180 bar, by means of a support and retaining structure, whereas the liquid metal distribution pipework is not fixed to this support structure.

In that design, the fluid tight vessel acts as a collector for the gas circuit and the sizing of the heat exchanger module is driven first and foremost by the gas, because, of the two fluids, that is the least effective at transferring heat.

Whereas the size of the exchange pattern of the gas circulation channels is strictly dependently on the thermos-hydraulic performance constraints, the size of the liquid metal circulation channels needs to take into consideration the risks of blockage associated with the circulation of the liquid metal, and this limits the minimum cross section of the circulation channels for this liquid. When the differences in physical characteristics, particularly density, between a gas and a liquid metal are also taken into consideration, a resulting exchanger module exhibits pressure drops in the liquid metal circulation channels that are very low, typically of the order of 40 mbar.

Furthermore, for the sake of compactness, each exchanger module has an individual thermal power of the order of a few tens of MWth, and this, with the rules on sizing, dictates that a module needs to have a very great number of fluid circulation channels, typically equal to around 5000.

Another constraint to be taken into consideration stems from the fact that each module is arranged inside a vessel pressurized by the gas.

In operation, the structures supplying and collecting the liquid metal, which consist of the headers and of the distribution pipework, may be subjected to compressive loadings at high pressure and without special precautions this could lead to damage by buckling with creep. Also, from a thermomechanical standpoint, these structures need to be designed to be compact as possible.

In other words, the configurations of the heat exchanger modules within the vessel pressurized by the gas, according to the aforementioned application WO2015/028923 A1, entails a very large number of channels per module, with a great compactness.

This configuration may lead to a nonuniform distribution of the liquid metal in the channels within each exchanger module, which may be detrimental on the one had to the overall thermal efficiency of the exchanger and on the other hand to the thermomechanical integrity of the structures of the exchanger.

In fact, the heat exchanger module functional requirements specification with which the inventors have been confronted can be summarized as follows:

- ensure mechanical integrity under pressure and at temperature both in the steady state and in the transient state;
- ensure homogenous distribution of flow between the heat exchange channels while at the same time keeping control over additional pressure drops;
- display low thermal inertia in order to limit the amplitude of the thermal stresses during rapid transience;
- be compatible with various module arrangements (parallel/series, stackable, etc.) in order to meet the objectives of power compatible with the flow rates and pressures in the fluid circuits.

Poor flow distribution is characterized by certain heat exchange channels being oversupplied at the expense of certain others.

In order to ensure satisfactory distribution, the applicant company has, in patent FR3054879B1, proposed a solution involving creating a forked zone, referenced Z3 in that patent, in the upstream or downstream continuity of the exchange zone proper. In outline, at constant flow rate, by creating four forks for a given inlet, the bore section is reduced by a factor of four and the pressure drops of the bundle of channels is increased by a factor of 16.

This solution therefore offers the prime advantage of quickly adding pressure drops to the bundle, although this may also become a disadvantage. This is why, in order to regulate the distribution while minimizing the additional pressure drops, patent FR3054879B1 also proposes a homogenization zone, referenced Z1 in that patent. In the manner of a grating positioned under the intake, this homogenization zone breaks up the effect of jets and places the channels and the plates of the one same fluid circuit in communication with one another in order to equalize the pressures. The benefit of this homogenization zone is that it is directly incorporated into the design of the plates. This is not an added element the attaching of which may become incompatible with the thermomechanical loadings. The zones references Z1, Z2, and Z3 in that patent FR3054879B1 form a kind of pre-header.

An improvement this patent FR3054879B1 is to create the plates with axial symmetry, the homogenization zones being arranged symmetrically on each side of the longitudinal axis of the plates, as illustrates in FIGS. 1A and 1B for a plate for circulating respectively liquid sodium and gas in an SFR nuclear reactor exchanger application. The sodium circulation plate 10 thus comprises a homogenization zone Z1 with forks at the axial inlet 100 and the axial outlet 200, and a heat exchange zone Z2 with rectilinear straight channels between these two zones Z1. The gas circulation plate 20 likewise comprises a homogenization zone Z1, likewise with forks onto which the two inlets 200 and the two outlets 201 open, and a heat exchange zone Z2, likewise with rectilinear straight channels between these two zones Z1, this zone Z2 of the plate 20 having the same length as the plate 10. This improvement is described in publication [1]. With this improvement, the overall thermal inertia of the plates 10, 20 is improved, and heat exchange modules can be stacked, this being advantageous in terms of bulk.

Be that as it may, this configuration still has a number of remaining drawbacks.

First of all, the arrangement of the pre-headers consisting of the homogenization zones Z1 means that the fluids arrive in the continuation of the exchange channels, being axial in the case of the sodium circulation plate and lateral against the longitudinal axis in the case of the gas circulation plates. Now, in a good many applications, notably in an SSR application, it would be desirable notably to be able to position an intake on the faces of an exchange module in order to run the circulation piping more easily outside of the modules, notably by minimizing the lengths of said piping.

In addition, in order to refine the distributions while keeping control over the pressure drops, it would be advantageous to dispense with the forks which very quickly increase these pressure drops.

Finally, with this configuration there are ultimately still zones of thermal inertia that remain, as symbolized by the circles in dotted line Z.I in FIG. 1B, which it would be advantageous to reduce.

There is therefore still a need to further improve plate heat exchanger modules, notably in order to simplify the piping in which the fluids circulate outside of the modules, to reduce the pressure drops within the modules, and to further reduce the zones of thermal inertia and do so while retaining the possibility of stacking modules with one another.

It is an object of the invention to address this need.

SUMMARY OF THE INVENTION

In order to do this, the invention relates to a heat exchanger module having at least two fluid circuits, of longitudinal axis (X) comprising a stack of plates, defining at least two fluid circuits, at least a part of the plates each comprising fluid circulation channels, the channels of at least one of the two circuits, referred to as first circuit, having:

- at least one fluid supply and distribution zone ($Z_H$) for supplying and distributing fluid from outside the stack, forming a fluid pre-header, in which zone the channels are delimited by studs distributed over the surface of the plate;
- an exchange zone ($Z_E$) continuous with the pre-header and in which the channels are each delimited by a groove separated from one another by a rib and extending along the longitudinal axis (X).

According to one advantageous embodiment, the module comprises two first-circuit pre-headers each arranged at one of the longitudinal ends of the stack, one of the two pre-headers forming a fluid inlet pre-header, the other forming a fluid outlet pre-header According to another advantageous embodiment, the channels of the other of the two circuits, referred to as second circuit, having:

- at least one fluid supply and distribution zone ($Z_H$) for supplying and distributing fluid from outside the stack, forming a fluid pre-header, in which zone the channels are delimited by studs distributed over the surface of the plate;
- an exchange zone ($Z_E$) continuous with the pre-header and in which the channels are each delimited by a groove, separated from one another by a rib and extending along the longitudinal axis (X).

According to this embodiment, the module advantageously comprises two second-circuit pre-headers each arranged at one of the longitudinal ends of the stack, one of the two pre-headers forming a fluid inlet pre-header, the other forming a fluid outlet pre-header.

According to a first advantageous embodiment variant, the studs of the first circuit and/or of the second circuit are solid.

According to second advantageous embodiment variant, the studs of the first circuit and/or of the second circuit are holed and open-ended so as to allow communication between channels of the plates of the supply and distribution zone of the first or of the second circuit but not with those of the plates of the second or respectively of the first circuit.

According to one advantageous embodiment, the module comprises at least at one of the longitudinal ends of the stack, a fluid header opening onto a lateral base plate of the stack onto which baseplate the channels of the first circuit pre-header open but not those of the second circuit pre-header.

According to this embodiment, the module advantageously comprises one of the longitudinal ends, a fluid header forming the first circuit inlet header (11) and, at the other of the longitudinal ends, a fluid header forming the first circuit outlet header.

According to another advantageous embodiment, the module comprises at least on one lateral side of the stack, a fluid header passing through the stack transversely to the axis (X) and opening onto the second channels of the pre-header of the second circuit but not onto those of the first circuit.

According to this embodiment, the module advantageously comprises at least on one same lateral side of the stack, a fluid header forming the second circuit inlet header and a fluid header forming the second circuit outlet header.

According to an alternative configuration, the studs are uniformly distributed in a staggered configuration over the surface of the plate of the pre-header in a triangular pattern.

According to another alternative, the studs uniformly distributed over the surface of the plate of the pre-header in a rectangular or square pattern.

As a further preference, the studs are of cylindrical overall shape.

As a further preference, the channels of the exchange zone of the first circuit and of the second circuit are straight, mutually parallel, and extending parallel to the longitudinal axis (X).

Advantageously, the stack being made up of metal plates assembled with one another either by hot isostatic pressing (HIP) or by uniaxial hot pressing (UHP) so as to obtain diffusion welding between the metal plates, or by brazing, or produced using additive manufacturing.

According to one advantageous configuration, a plate of the first circuit is interposed between two plates of the second circuit at least in the central part of the stack.

The invention also relates to a heat exchanger comprising a plurality of heat exchanger modules as described hereinabove.

According to an advantageous configuration, the aforementioned modules are arranged side by side with the second circuit inlet and outlet headers passing through and laterally connecting the modules.

The invention also relates to the use of the heat exchanger as described hereinabove, the fluid of the first circuit, by way of primary fluid, being a liquid metal and the fluid of the second circuit, by way of secondary fluid, being a gas or a gas mixture.

In a variant, the fluid of the second circuit mainly contains nitrogen and the fluid of the first circuit is liquid sodium.

The fluid of the first or of the second circuit may come from a nuclear reactor.

The invention also relates to a nuclear facility comprising a liquid metal fast neutron reactor, notably a sodium fast reactor SFR or Na-called SNR and a heat exchanger comprising a plurality of exchanger modules as described hereinabove. Thus, the invention essentially consists in producing an exchanger module with plates that are stacked or produced by additive manufacturing, in which at least one of the pre-headers of one of the fluid circuits is produced with studs distributed over the surface of the plate and delimiting the channels in which the fluid circulates before reaching its heat exchange zone.

These studs ensure the integrity of the plates under pressure while at the same time having low thermal inertia.

The studs ensure homogenous distribution of the fluid while minimizing the addition of pressure drops and do so independently of the geometry of the channels of the heat exchange zone.

The geometric shapes and the distributions of these studs can be modified as desired in order to control the distribution of the fluid according to the envisioned application and the constraints thereof, notably in terms of temperature and pressure.

The density of studs in the pre-header can also be varied.

By virtue of the studs according to the invention in place of the forks according to patent FR 3054879B1, the invention thus does away with the zones of thermal inertia Z.I as illustrated in FIG. 1B.

Furthermore, the studs according to the invention make it possible to do fine exchanger module geometries having a fluid intake and outlet on the one same longitudinal face of the module, in order to obtain a side by side arrangement of modules and minimize the lengths of the piping between them.

All applications requiring heat exchangers or steam generators can be envisioned with the exchanger modules according to the invention, including all types of nuclear reactor, GEN 3, GEN 4, SMR (Small Medium Reactor), urban heating networks, EHT electrolyzers, the oil and gas industry, the solar energy industry, the chemical industry, etc.

Further advantages and features will become better apparent on reading the detailed description, given by way of illustrative and non-limiting example, with reference to the following figures.

BRIEF DESCRIPTION OF THE DRAWING

FIG. 13 is a schematic view showing an advantageous arrangement of several exchanger modules according to the invention.

FIG. 14 illustrates a numerical simulation showing the flow of fluid notably in a homogenization zone forming a pre-header according to the invention for a stack of nine $N_2$ circulation plates.

DETAILED DESCRIPTION

For the sake of clarity, the same elements are denoted by the same numerical references according to the prior art and according to the invention.

It is emphasized that throughout the application, the terms "inlet", "outlet", "upstream", "downstream" are to be understood in relation to the direction in which the fluid concerns circulates in the heat exchange module according to the invention.

Figure 1A:
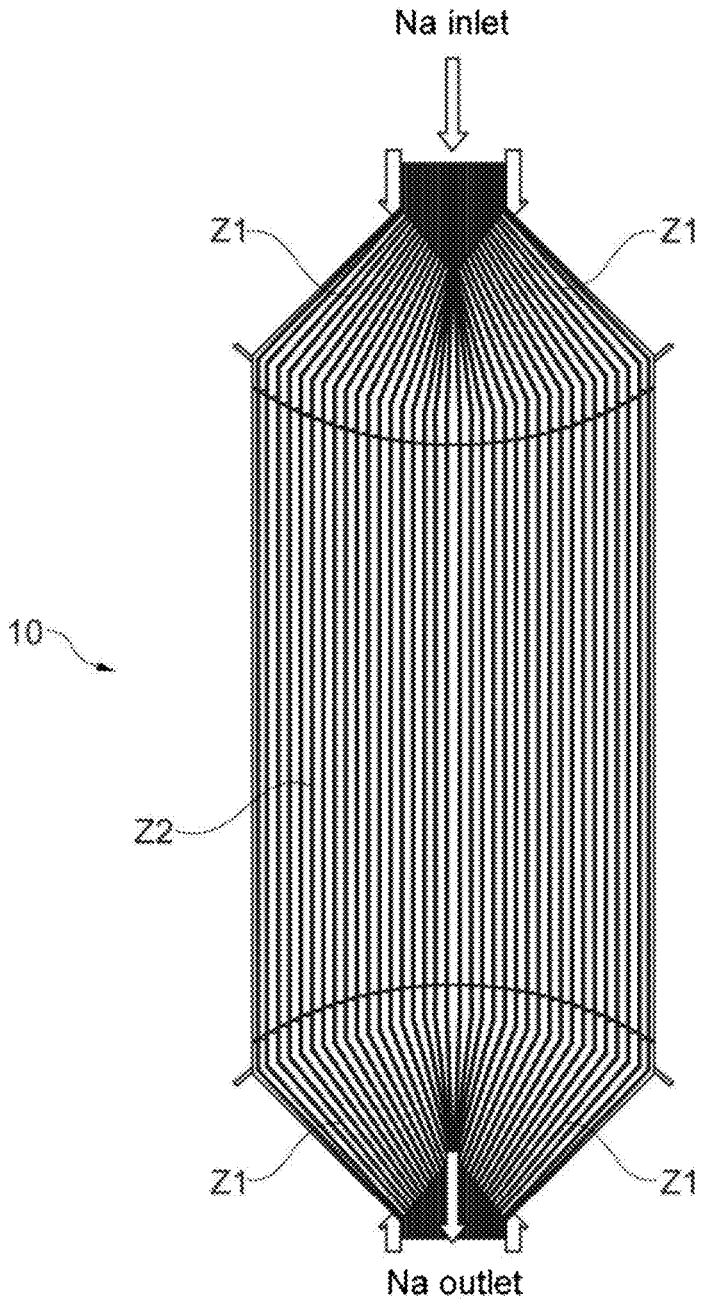
Fig. 1A (PRIOR ART)
FIG. 1A is a view of a plate with liquid sodium circulation channels for a heat exchanger module according to the prior art, intended for an SFR reactor.
Figure 1B:
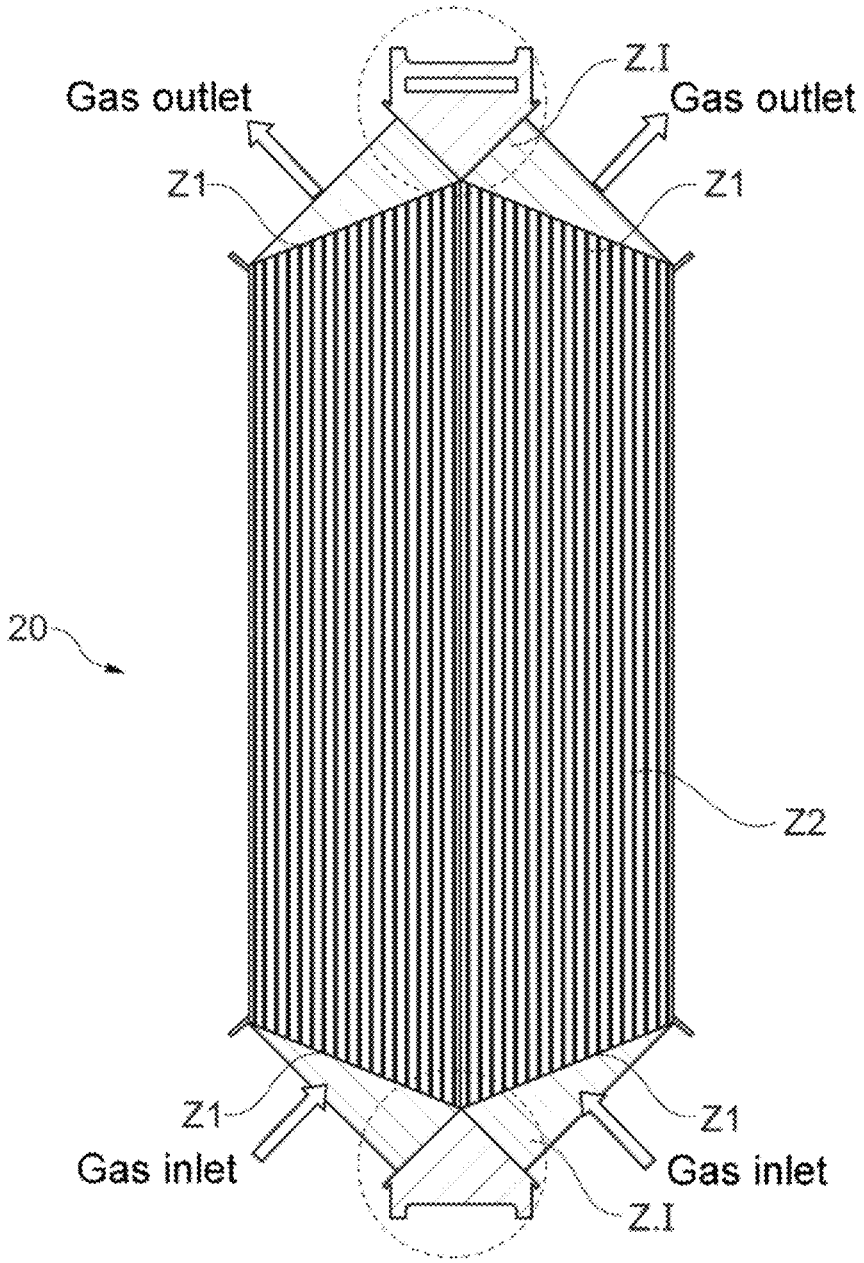
Fig. 1B (PRIOR ART)
FIG. 1B is a view of a plate with gas circulation channels for the exchanger module with sodium circulation plate according to FIG. 1A.

FIGS. 1A and 1B relating to the prior art were already commentated on in the preamble. They will therefore not be commented upon hereafter.

Figure 2:
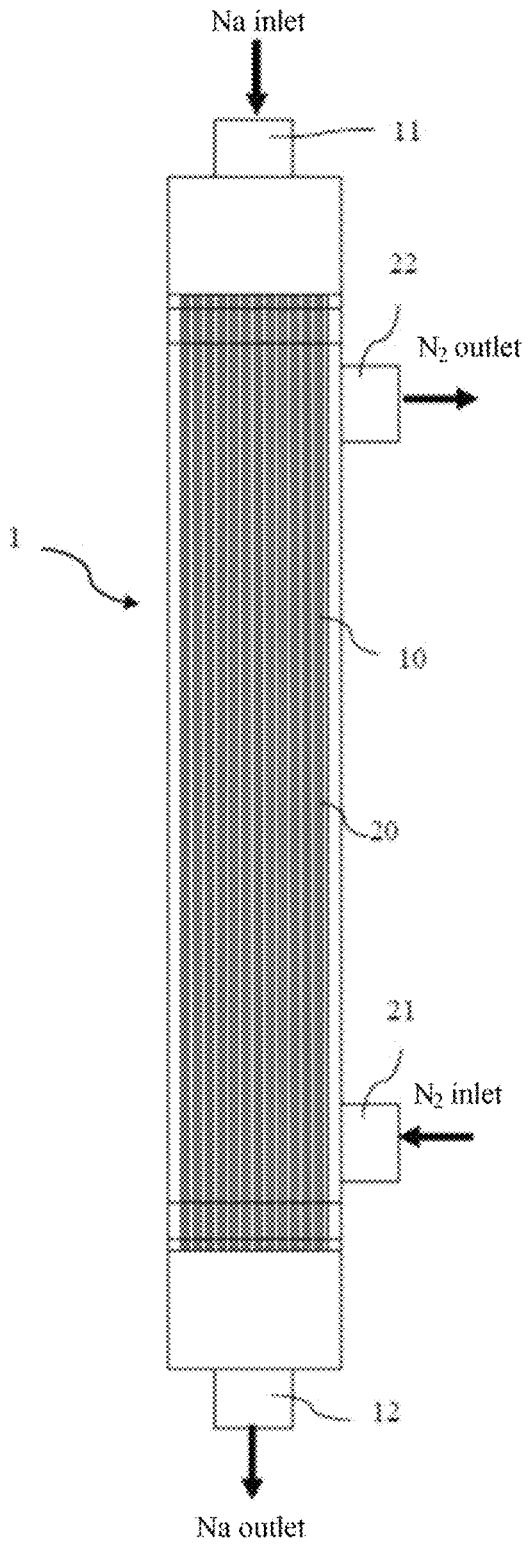
FIG. 2 is a longitudinal side view of a heat exchanger module according to the invention.
Figure 3:
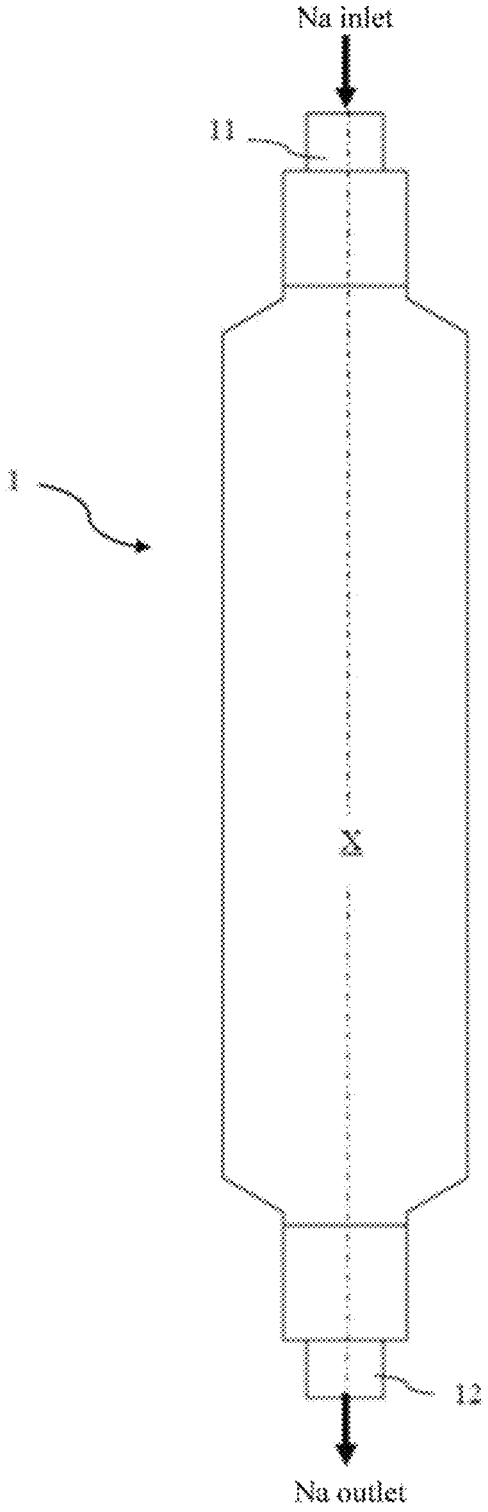
FIG. 3 is a face-on view of the exchanger module according to FIG. 2.

FIGS. 2 and 3 depict an embodiment of a heat exchanger module according to the invention with two fluid circuits, which is employed by way of example for an exchange between liquid sodium (Na) and nitrogen ($N_2$).

The module 1 is made up of an alternating stack of metal plates 10, 20 assembled with one another by the fusion welding, preferably using an HIP technique, or produced by additive manufacturing.

As visible in these figures, this module 1, which extends along a central axis (X), incorporates two headers 11, 12, these respectively being a liquid sodium (Na) inlet and outlet, one of them arranged at the top of the module along the axis X and the other being arranged also along the axis X of the module but at the bottom. As detailed hereinafter, each of the headers 11, 12 opens onto a lateral base plate of the stack of plates onto which base plate the channels of the Na circuit open, but those of the $N_2$ circuit do not.

The module 1 also comprises two headers 21, 22, these respectively being the nitrogen ($N_2$) inlet and outlet headers, arranged on the one same longitudinal face, respectively at the bottom of the module and at the top of the module. As detailed hereinafter, each of these inlet header 21 and outlet header 22 passes through the stack transversely to the axis X and opens onto the channels of the $N_2$ circuit but not onto the Na circuit.

In such a module 1, the circulation of the fluids (Na, $N_2$) is therefore counterflow circulation.

Figure 4A:
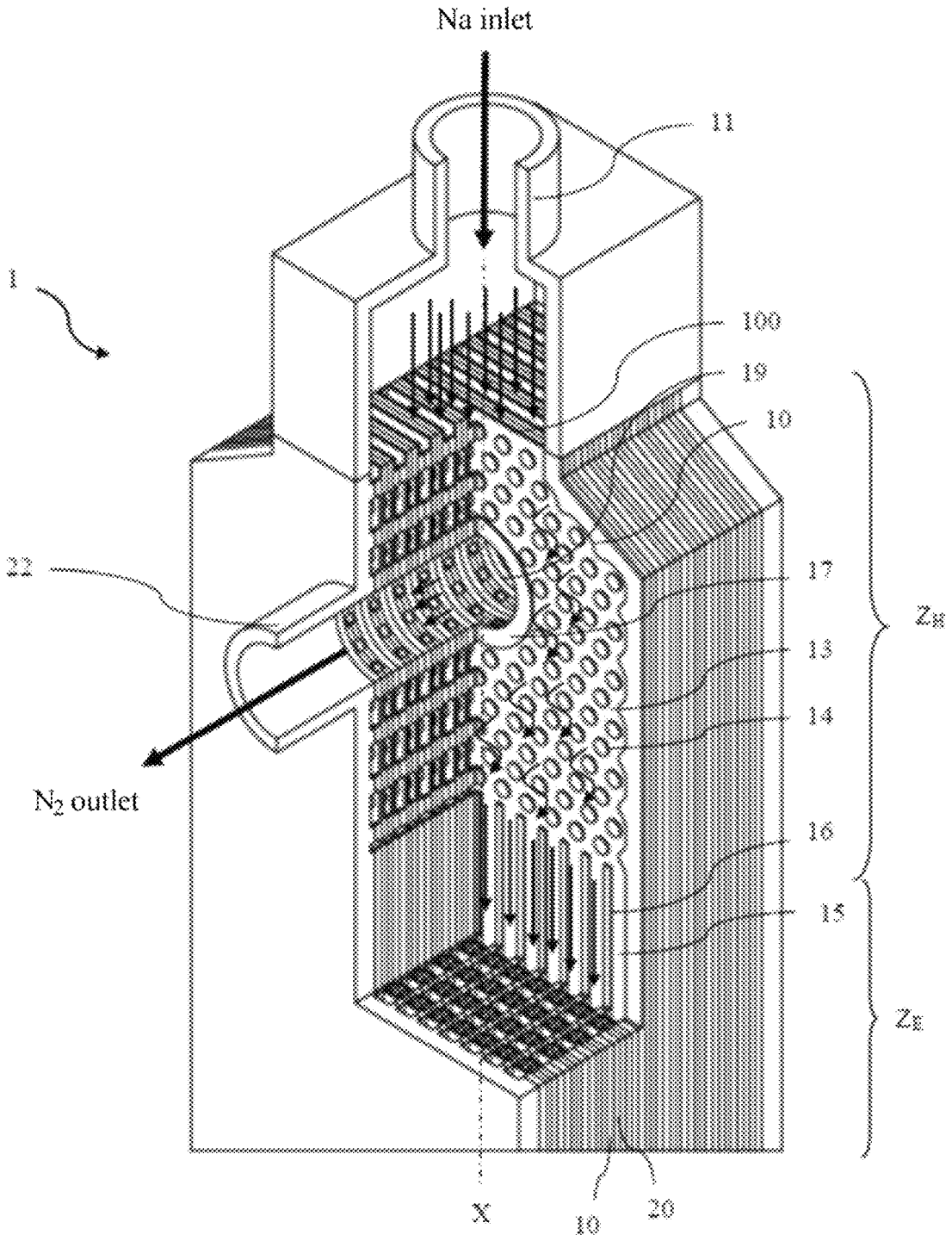
FIG. 4A is a perspective view with partial cutaway of an exchanger module according to a first alternative of the invention, FIG. 4A showing the circulation of the liquid sodium within a dedicated channel plate.
Figure 4B:
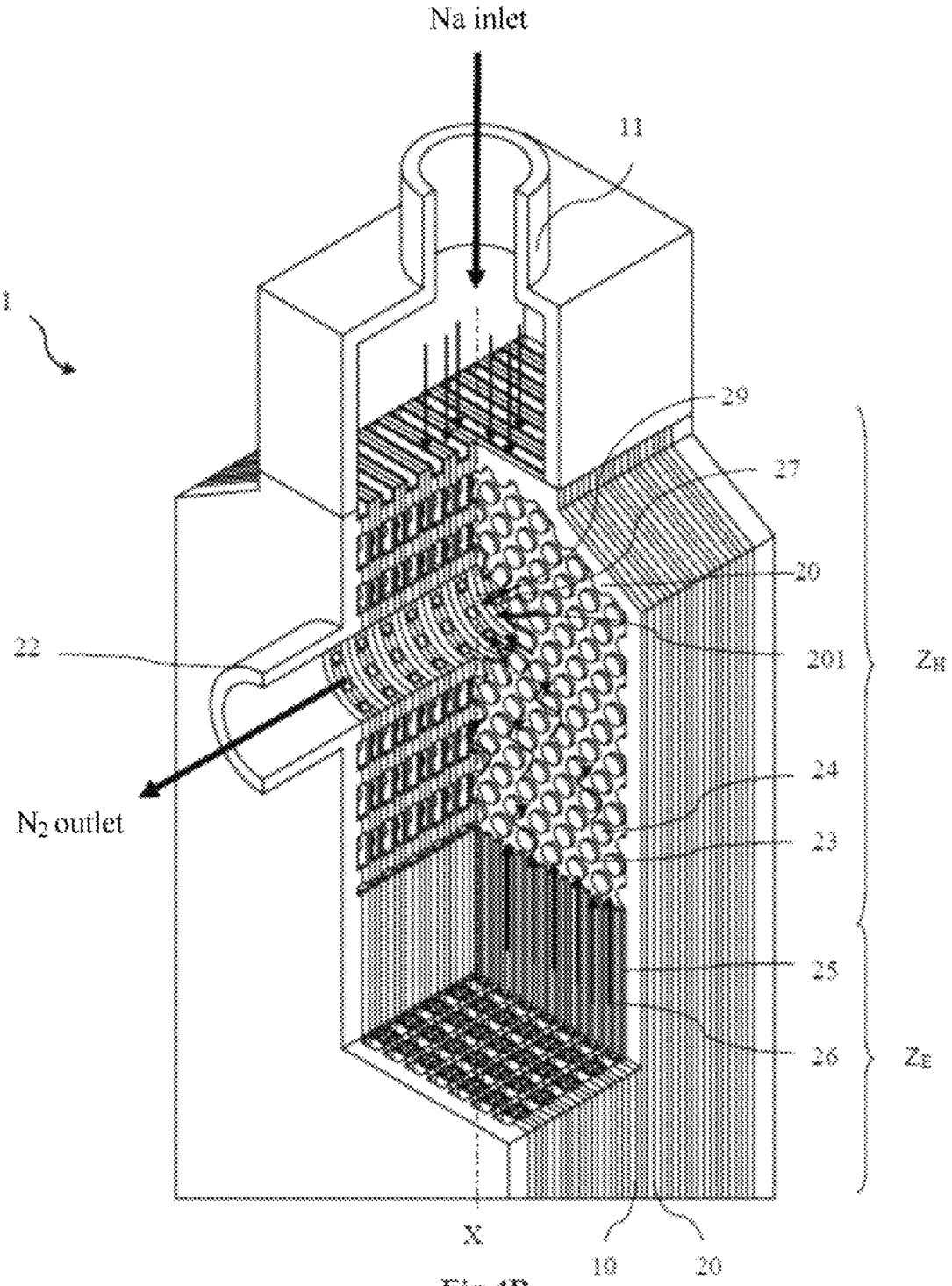
FIG. 4B is a perspective view with partial cutaway of an exchanger module according to the first alternative of the invention, FIG. 4B showing the circulation of the gas typically $N_2$, in a dedicated channel plate.

FIGS. 4A and 4B show the stack and respectively the circulation within an Na circulation plate 10 and an $N_2$ circulation plate 20, the arrows symbolizing the circulation of each of the fluids in each plate concerned.

Figure 5:
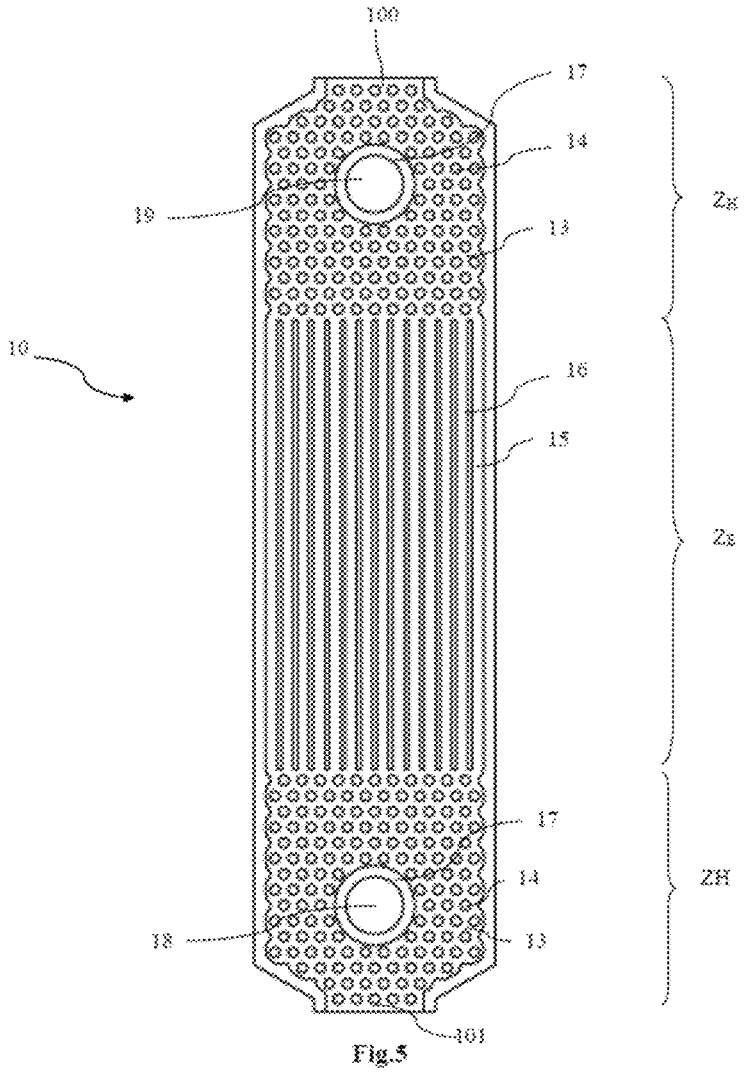
FIG. 5 is a face-on view of a plate with liquid sodium circulation channels according to the first alternative of the invention.
Figure 5A:
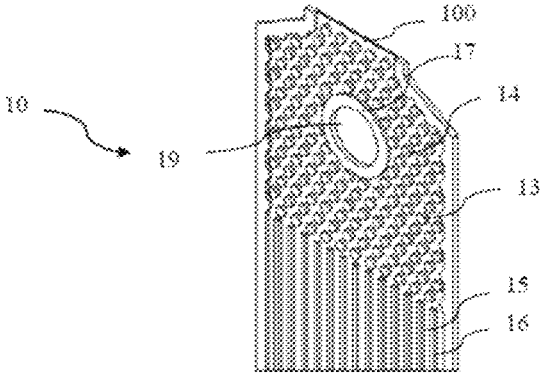
FIG. 5A is a partial perspective view of the plate according to FIG. 5.

FIGS. 5, 5A show an Na circulation plate 10.

A plate 10 comprises two supply and distribution zones $Z_H$ each forming a fluid pre-header, these being arranged one on each side of a heat exchange zone $Z_E$.

According to the invention, the channels 13 of a pre-header $Z_H$ are delimited by solid cylindrical studs 14 distributed over the surface of the plate. As a preference, as shown in FIGS. 4A, 5 and 5A, the solid cylindrical studs 14 are uniformly distributed in a staggered configuration on the surface of the plate of the pre-header. More specifically, this staggered distribution is in a triangular pattern that remains identical over the entire surface of the plates 10 of the pre-header $Z_H$. A distribution in a triangular pattern allows better filling of the volume of the pre-header by the studs 14 and is accorded preference in order to ensure the ability of the exchanger module to withstand pressure.

The channels 13 delimited by the solid cylindrical studs 14 open onto the channels 15 of the heat exchange zone $Z_E$ which is continuous with the pre-header. As shown, the channels 15 of the exchange zone are each delimited by a groove 15 separated from one another by a rim 16 and extending along the longitudinal axis (X). As a preference, as shown, they are straight, mutually parallel, and run parallel to the longitudinal axis (X) of the module 1.

The studs 14 may be of a height such that they come to bear directly against a plate 20. As illustrates in FIG. 4C, it is also possible to envision two adjacent plates 10 with cylindrical studs 14 of which the height represents part of the height of a channel 13 and which, once the plates have been assembled with one another, define the total height of the channel. The same is true of the ribs 16. The arrangement of the studs 14 ensures the ability of the plates 10 to withstand pressure.

A ring 17 extends around each of two holes 18, 19 of circular section each opening through the plate 10 within one of the pre-headers. These open-ended holes 18, 19 form part of the tube of the respectively inlet and outlet circulation header of the other, $N_2$ circuit. The ring 17 thus forms a fluid tight barrier between the Na and $N_2$ circuits in the region of the pre-headers of the plates 10.

With such a plate 10, as illustrate in part in FIG. 4A, the liquid sodium is supplied form the inlet tubular header 11 to be distributed from the inlet 11 of the channels 13 delimited by the studs 14. The liquid sodium circulates in the channels 13 around the studs 14 of the inlet pre-header to arrive at the channels 15 of the heat exchange zone $Z_E$ then circulates around the studs 14 of the outlet pre-header to be removed via the outlet 101 of the channels 13 and recovered by the outlet header 12.

Figure 6:
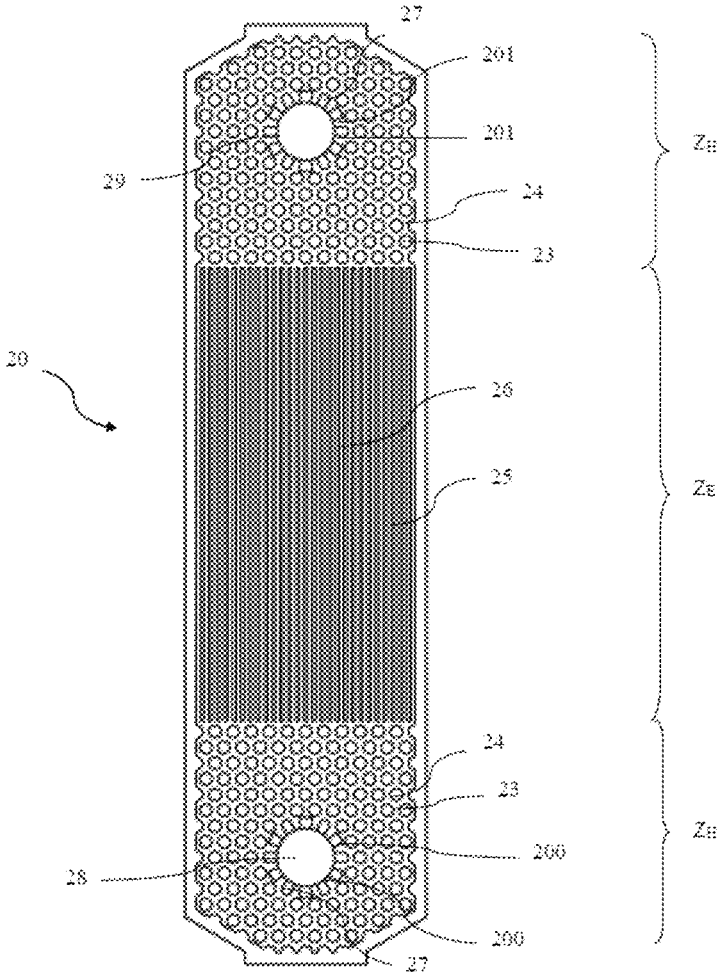
FIG. 6 is a face-on view of a plate with gas circulation channels according to the first alternative of the invention.
Figure 6A:
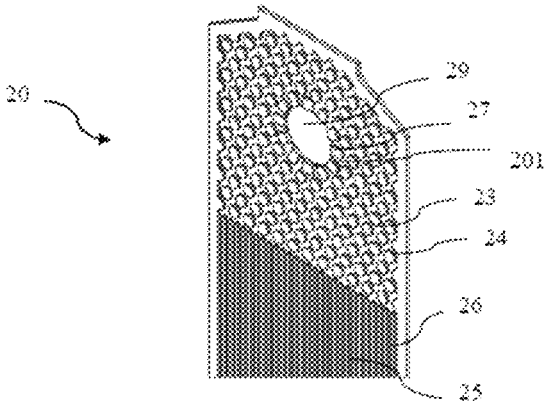
FIG. 6A is a partial perspective view of the plate according to FIG. 6.

FIGS. 6, 6A show an $N_2$ circulation plate 20 produced in a similar way to an Na circulate plate 10.

Thus, a plate 20 comprises two supplied distribution zones $Z_H$ each forming a fluid pre-header, and which are arranged one on each side of a heat exchange zone $Z_E$.

The channels 23 of a pre-header $Z_H$ are delimited by side cylindrical studs 24 distributed over the surface of the plate. As a preference, as shown in FIGS. 4B, 6 and 6A, the solid cylindrical studs 24 are uniformly distributed in a staggered configuration over the surface of the plate of the pre-header. Here again, this staggered configuration is in a triangular pattern that remains identical over the entire surface of the plates 20 of the pre-header ZH. A distribution in a triangular patterns allows better filling of the volume of the pre-header by the studs 24 and is accorded preference in order to ensure the ability of the exchanger module to withstand pressure.

The channels 23 delimited by the solid cylindrical studs 24 open onto the channels 25 of the heat exchange zone $Z_E$ which is continuous with the pre-header. As shown, the channels 25 of the exchange zone are each delimited by a groove 25 separated from one another by a rib 26 and extending along the longitudinal axis (X). As a preference, as shown, they are straight, mutually parallel, and run parallel to the longitudinal axis (X) of the module 1.

Figure 4C:
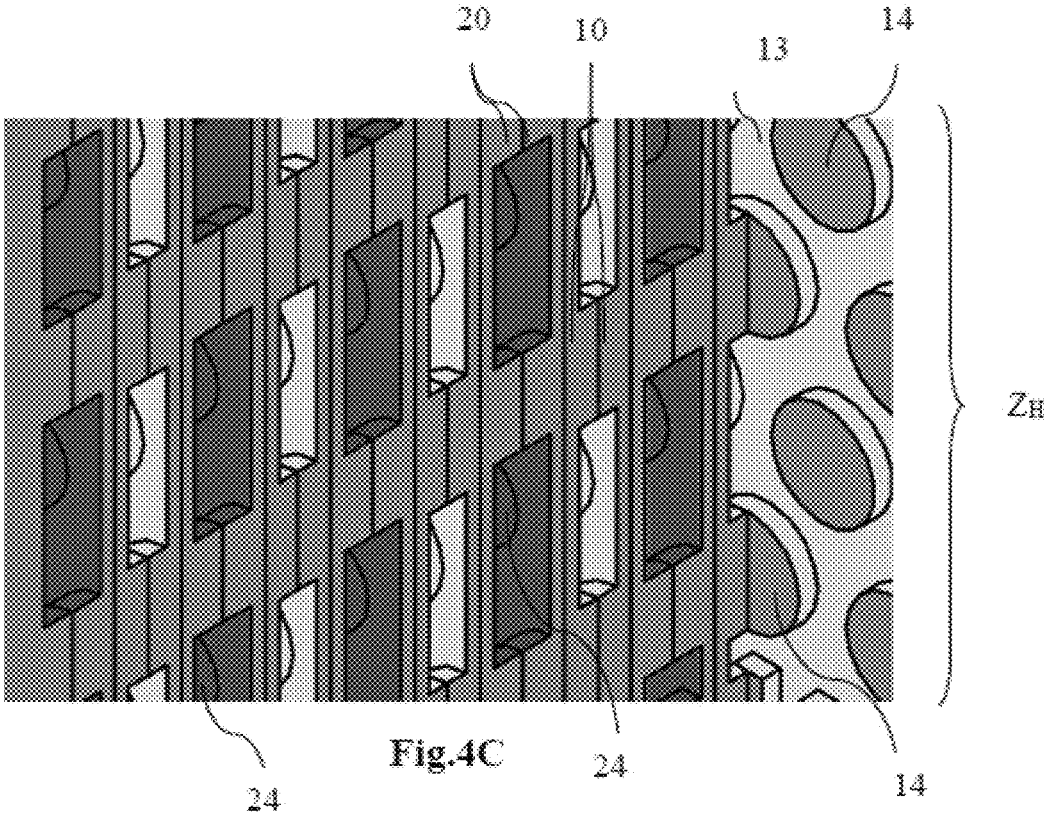
FIG. 4C is a detailed view of FIG. 4A showing the alternating stack of liquid sodium and gas circulation plates in the region of their homogenization zones.

The studs 24 may be of a height such that they come to bear directly against a plate 20. As illustrated in FIG. 4C, it is also possible to envision two adjacent plates 20 with cylindrical studs 24 of which the height represents part of the height of a channel 23 and which once the plates have been assembled with one another define the total height of the channel. The same is true of the ribs 26. The arrangement of the studs 24 ensures the ability of the plates 20 to withstand pressure.

Two holes 28, 29 of circular cross section each open through the plate 20 in one of the pre-headers. These open-ended holes 28, 29 form part of the tube of the respectively inlet and outlet circulation header of the other, $N_2$, circuit.

Studs 27 of trapezoidal shape are uniformly distributed around each of the holes 28, 29 to delimit inlet 200 or outlet 201 channels of uniform dimensions which therefore connect each of the holes 28, 29 to one of the respectively inlet and outlet pre-headers $Z_H$.

With such a plate 10, as is illustrated in part in FIG. 4B, the nitrogen is supplied from the inlet tubular header 21 which passes through the stack of plates 10, 20 to be distributed into the inlet channels 200 and then into the channels 23 delimited by the studs 24. The nitrogen circulates around the studs 24 of the inlet pre-header to reach the channels 25 of the heat exchange zone $Z_E$ and then circulates in the channels 23 around the studs 24 of the outlet pre-header to be removed by the outlet channels 201 and then recovered by the outlet header 22.

Thus, according to the invention, the studs 14, 24 ensure homogeneous distribution of each of the fluids, i.e. the liquid sodium and the nitrogen respectively, independently of the geometry of the channels 15, 25 of their heat exchange zone $Z_E$ and do all of this while having low thermal inertia and minimizing added pressure drops. Furthermore, as already mentioned, the studs 14, 24 are dimensioned to ensure the ability to withstand the pressure. Typically the studs 24 are dimensioned to ensure an ability to withstand a nitrogen pressure of the order of 180 bar.

In the alternative of the module illustrates in FIGS. 4A to 6A, the studs 14, 24 of the plates 10, 20 of the two (Na, $N_2$) fluid circuits are aligned, which is to say that the axis of revolution of a stud 14 is aligned with that of a stud 24. For each plate 10 or 20 the arrangement of the studs 14 or 24 of the one same plate is in a staggered configuration so as to have a stud 14, 24 facing a channel 17, 25 of the heat exchange zone $Z_E$.

It is also possible to envision an offsetting, in other words a lateral offsetting of the studs over the surface of the plates. Such offsetting allows the creation of studs pierced with open-ended holes. This offsetting is accompanied by a change from a distribution in a triangular pattern as illustrated for the previous alternative to a distribution in a rectangular or square pattern.

Over the one same surface, there are fewer studs when they are distributed in a rectangular or square pattern than when they are distributed in a triangular pattern. As a result, this impairs the ability to withstand pressure, but does leave space for holing the studs.

Such an alternative embodiment of a module 1' is shown in FIGS. 7A to 9A in which the studs 14', 24' of the plates 10', 20' respectively are holed, opening between the plates 10 or 10 of the one same fluid, Na or $N_2$, circuit.

Figure 7A:
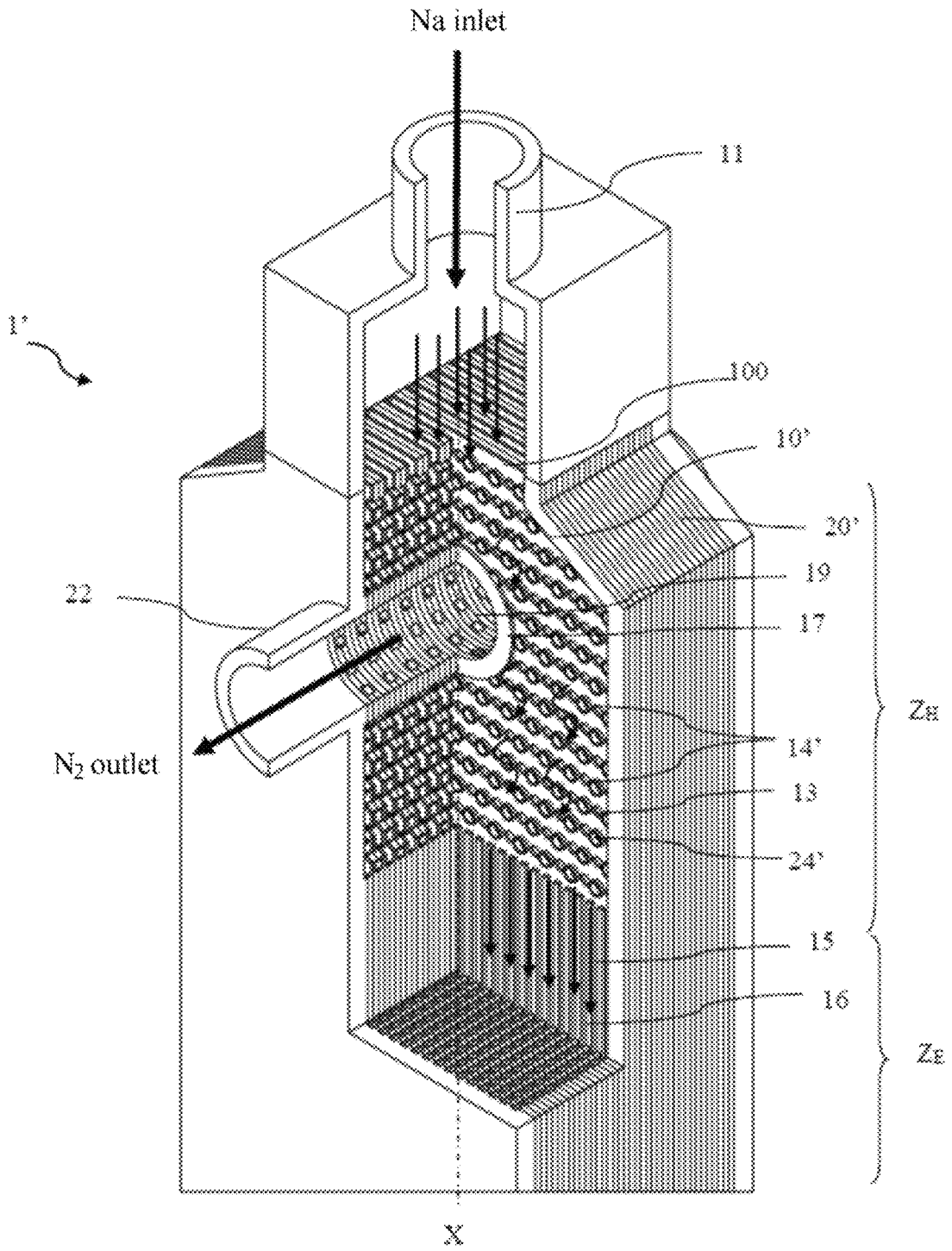
FIG. 7A is a perspective view with partial cutaway of an exchanger module according to a second alternative of the invention, FIG. 7A showing the circulation of the liquid sodium within a dedicated channel plate.
Figure 7B:
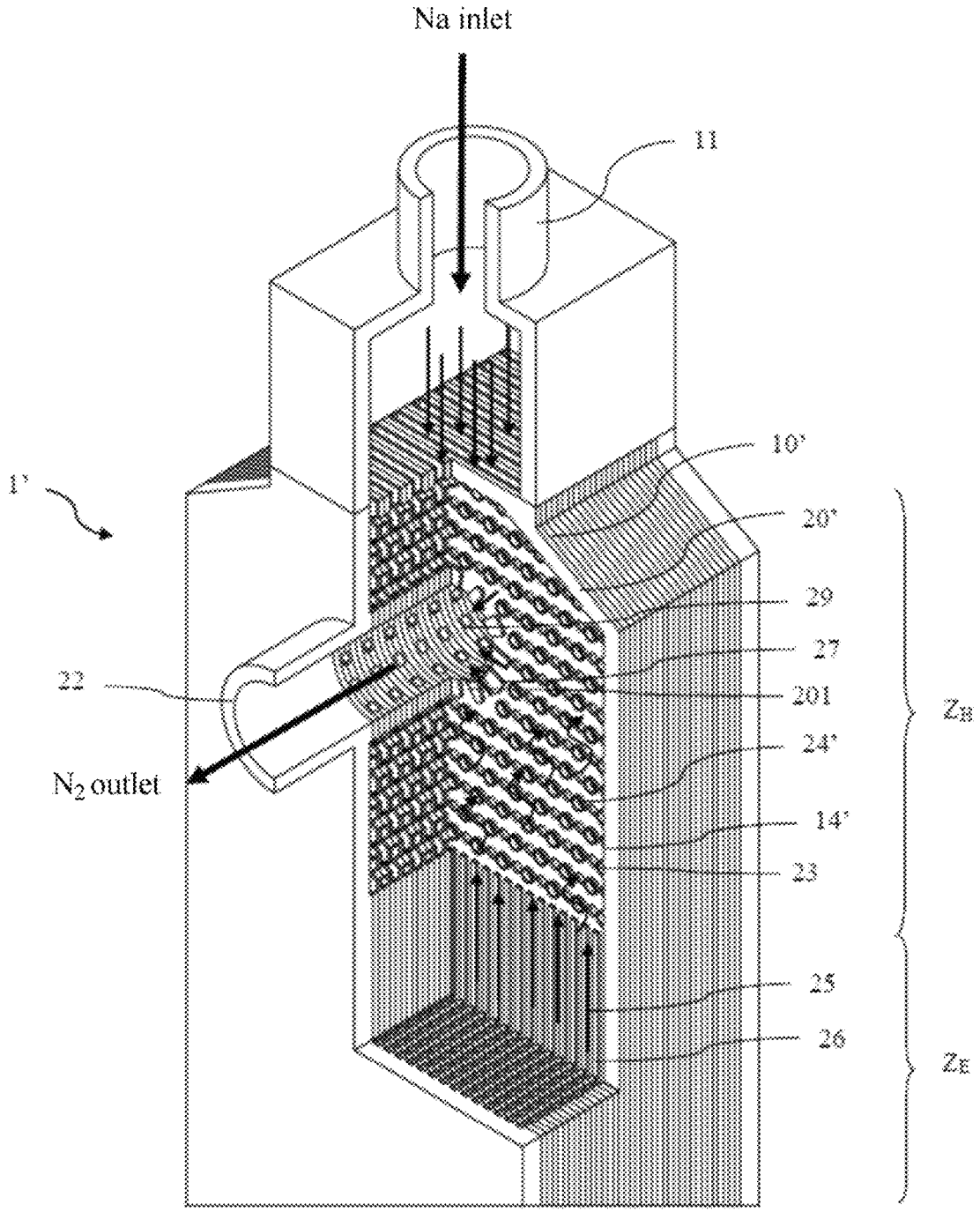
FIG. 7B is a perspective view with partial cutaway of an exchanger module according to the second alternative of the invention, FIG. 7B showing the circulation of the gas, typically $N_2$, within a dedicated channel plate.
Figure 7C:
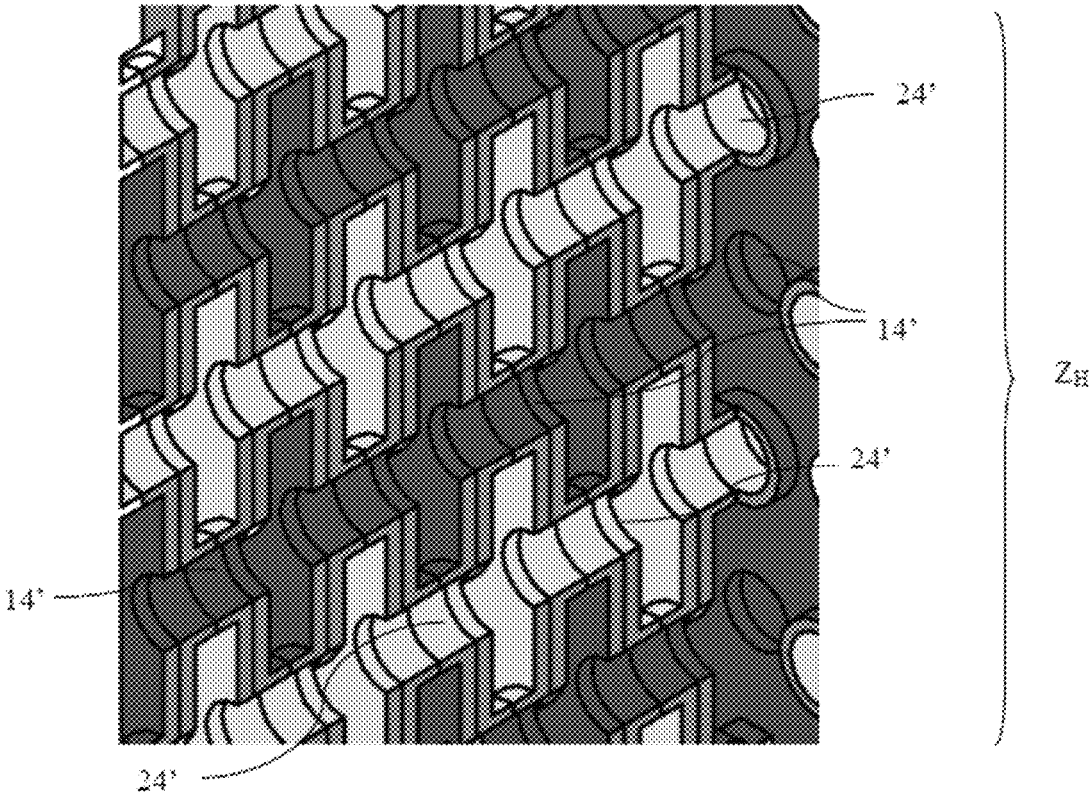
FIG. 7C is a detailed view of FIG. 7A showing the alternating stack of liquid sodium and gas circulation plates at the region of their homogenization zone.
Figure 8:
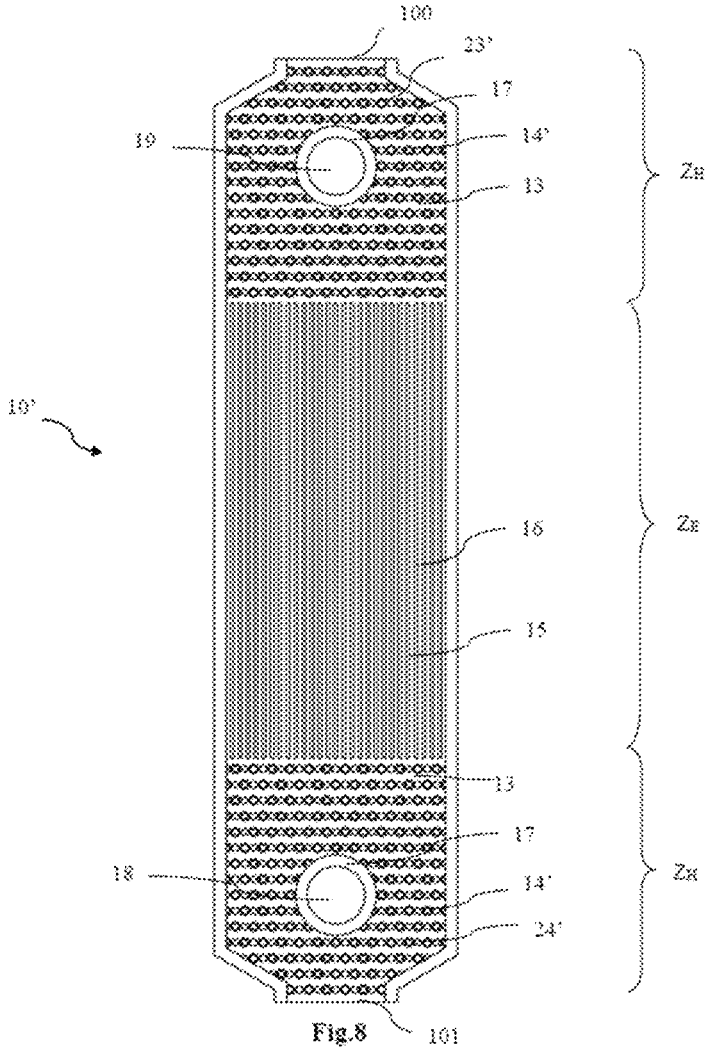
FIG. 8 is a face-on view of a plate with liquid sodium circulation channels according to the second alternative of the invention.
Figure 8A:
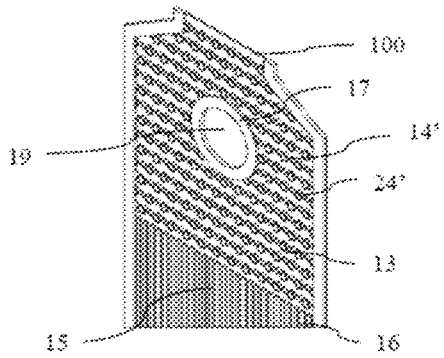
FIG. 8A is a partial perspective view of the plate according to FIG. 8.
Figure 9:
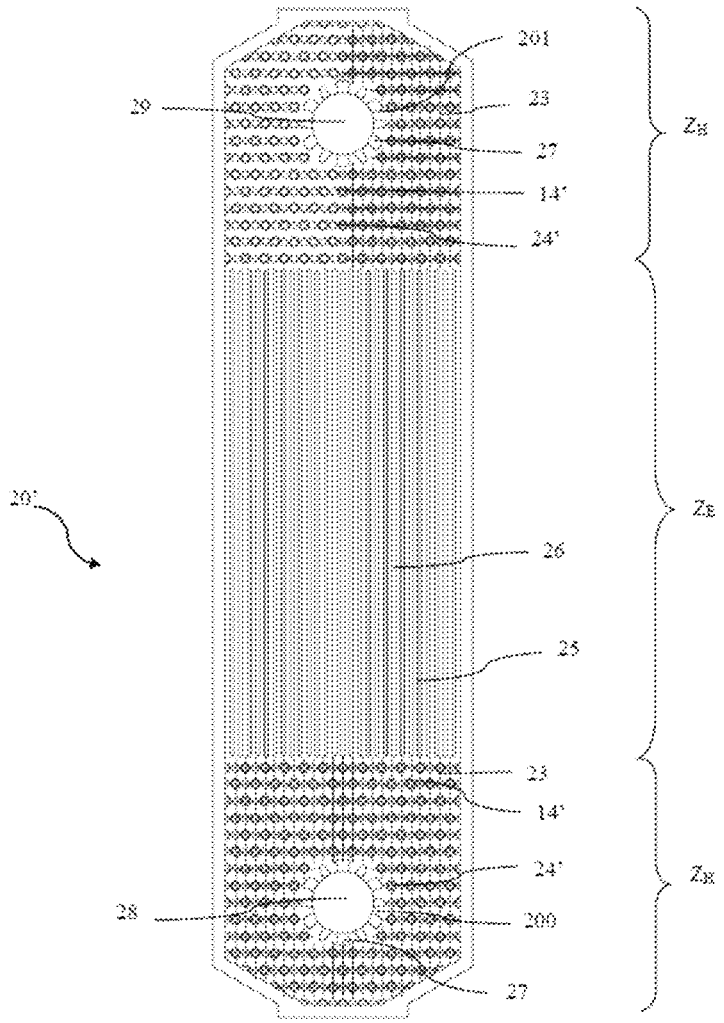
FIG. 9 is a face-on view of a plate with gas circulation channels according to the second alternative of the invention.
Figure 9A:
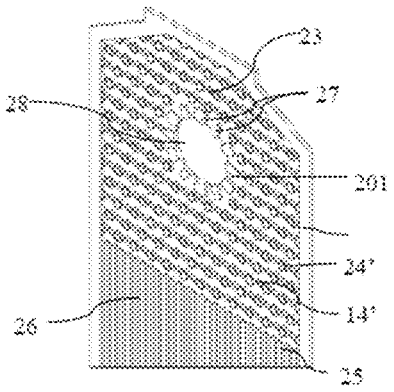
FIG. 9A is a partial perspective view of the plate according to FIG. 9.

As shown in FIG. 7C, the hole studs 14', 24' thus create communications between the plates 10, 20 of the one same, Na or $N_2$ circuit, in the region of the pre-headers $Z_H$, while at the same time maintaining fluid tightness with the other, respectively $N_2$ or Na, circuit.

This alternative with open-ended hole studs 14', 24', allows the fluid pressures to be equalized between the plates 10', 20'.

Figure 10:
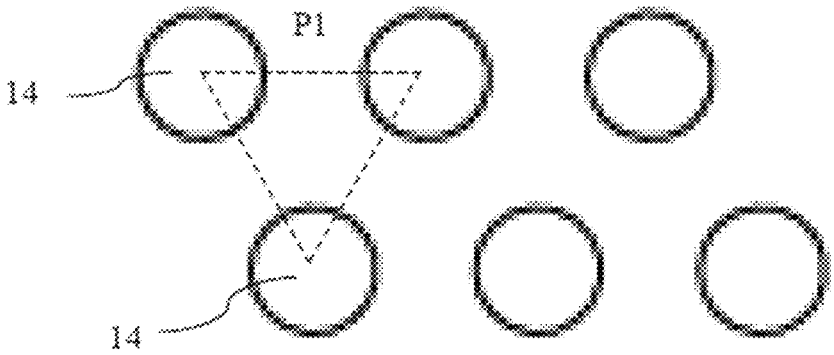
FIG. 10 is a face-on detailed view showing a staggered distribution in a regular triangular pattern of the studs of a channel plate according to the invention.
Figure 11:
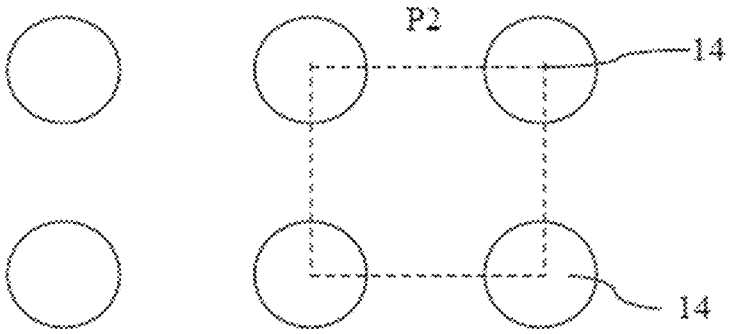
FIG. 11 is a face-on detail view showing the distribution in a regular square pattern of the studs of a channel plate according to the invention.

FIG. 10 illustrates in detail an alternative staggered configuration of the studs 14 of a plate 10 of the Na circuit in an equilateral triangular pattern defined by a pitch spacing P1.

FIG. 10 illustrates another alternative distribution whereby the studs 14 are distributed in a square pattern defined by a pitch spacing P2.

One or other of these alternatives can be implemented for the studs 24 of the plates 20 of the other circuit.

In FIGS. 2, 3, 4A, 4B, 7A, 7B the tube of the respectively inlet and outlet headers 11, 12, outside of the stack of plates, is arranged along the longitudinal axis X.

Other arrangements of the header tubes may also be envisioned.

Figure 12A:
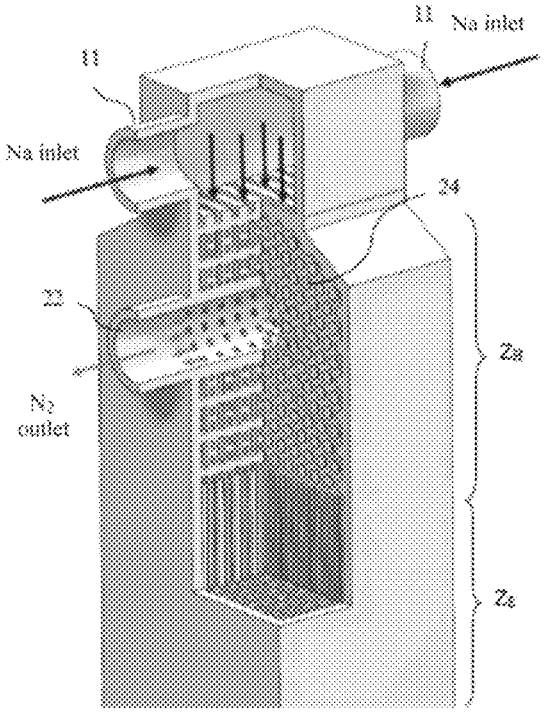
FIG. 12A is a perspective view with partial cutaway of an exchanger module according to a liquid sodium carrying variant, FIG. 12A showing the circulation of the liquid sodium within a dedicated channel plate.
Figure 12B:
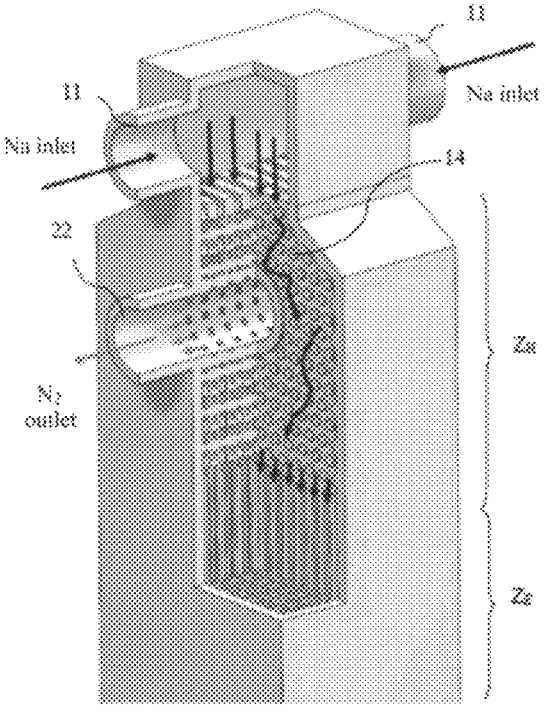
FIG. 12B is a perspective view with partial cutaway of an exchanger module according to the liquid sodium conveying variant, FIG. 12B showing the circulation of the gas in a dedicated channel plate.

Thus, a variant arrangement is illustrated in FIGS. 12A and 12B, whereby two tubes 11, 12 arranged orthogonally to the axis X and therefore parallel to the nitrogen circuit inlet and outlet headers 21, 22 are envisioned. As shown in FIGS. 12A, 12B, this arrangement still allows the plates 10 to be supplied with liquid sodium along the longitudinal axis of the exchanger module 1.

As already specified, creating pre-headers with studs 14, 24 according to the invention allows the inlet and outlet headers 21, 22 for one of the fluids to be arranged on the one same longitudinal face of a module 1.

This arrangement advantageously facilitates the relative arrangement of several modules and minimizes the lengths of piping connecting these.

One example of such an arrangement of exchange modules is shown in FIG. 13 which depicts three exchanger modules 1.1, 1.2, 1.3 arranged side by side and directly connected to one another by the tubes 21, 22 of the nitrogen circuit inlet and outlet headers, which tubes are rectilinear and straight.

The inventors have already mechanically predimensioned an exchanger module 1, 1' according to the invention for use in the exchange of heat between sodium (Na) and gas ($N_2$) as in the context of an SFR nuclear reactor.

The temperatures and pressures in the Na and $N_2$ circuits are summarized in table 1 below.

TABLE 1

| | Na circulation plate 10 | $N_2$ circulation plate 20 |
|---|---|---|
| T inlet (° C.) | 530 | 290 |
| T outlet (° C.) | 345 | 515 |
| Pressure Bar | 5 | 180 |

The predimensioning was performed with a range of triangular pitch spacing of channels 13, 23, i.e. with 6 to 12 mm spacing between studs 14, 24, and diameters from 4 to 8 mm of cylindrical studs 14, 24.

With these mechanical predimensionings thus achieved, the inventors concluded that an exchanger module 1 according to the invention had a good ability to withstand pressure.

Furthermore, fluid dynamic studies made is possible, through an iterative process of computational fluid dynamics (CFD) and computer aided design (CAD) made is possible to converge upon a design of exchange module 1 with a maldistribution of fluids, namely a standard deviation of flow rates between exchange channels for the one same fluid that is less than 5% across all of the channels 13, 23, 15, 25.

Figure 15:
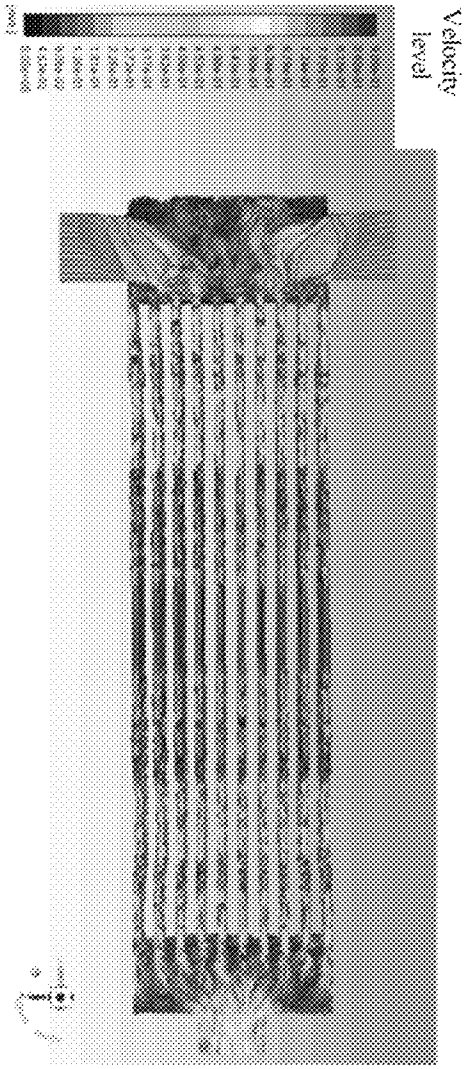
FIG. 15 illustrates a numerical simulation showing the flow of fluid notably in a homogenization zone forming a pre-header according to the invention for a stack of ten Na circulation plates.

FIGS. 14 and 15 illustrate the flow in the pre-headers with studs for the stacks of, respectively, nine N2 circulation plates 20 and ten Na circulation plates 10. The modules 1 with such pre-headers respectively exhibit a maldistribution of 4.0% (N2) and 4.7% (Na).

Other variant sand improvements may be envisioned without thereby departing from the scope of the invention.

The stud geometries and the periodicity of the pitch spacing of the rectangular, square or triangular pattern and the distribution thereof needs to be determined according to the application by following the usual rules of sizing, mechanical ability to withstand pressure, pressure drops, and fluid flow distribution in the channels.

While in all of the examples illustrated, all the plates 10 and 20 are produced using pre-headers with studs 14, 24, it is possible to use this approach only on those of a single fluid circuit, it being possible for the other to comprise conventional pre-headers.

Shapes other than cylindrical studs 14, 24 may be envisioned. For example, it is possible to envision elliptical, teardrop, etc. geometries.

It is possible to envision combining the two alternatives, namely with the plates of one circuit, for example those referenced 10, having solid studs and the plates of the other circuit, for example those referenced 20, having open-ended holed studs.

Furthermore, while in the examples illustrated, the channels of the heat exchange zone ($Z_E$) are straight channels, the pre-header according to the invention is independent of this particular geometry and it is therefore possible envision other geometries for the heat exchange channels ($Z_E$), for example channels of curved, zigzag, double zigzag, etc. shape. Further, regardless of the geometry adopted, ultimately, the depth of the exchange channels determines the height of the studs of the pre-header according to the invention.

LIST OF CITED REFERENCES

[1]: D. Plancq et al. "*Status of the astrid gas power conversion system option*"; HAL Id: cea-02338590; https://hal-cea.archives-ouvertes.fr/cea-02338590, Feb. 21, 2020.

The invention claimed is:

1. A heat exchanger module having a longitudinal axis, the heat exchanger module comprising:

a stack of plates, defining at least two fluid circuits, at least a part of each of the plates comprising fluid circulation channels, wherein a first circuit of the at least two circuits includes a first fluid supply and distribution zone for supplying and distributing a first fluid from outside the stack, forming a first fluid pre-header, in which first pre-header channels are delimited by first studs distributed over a surface of each plate of the first circuit; and a first exchange zone continuous with the first pre-header and in which first exchange channels are each delimited by a groove, separated from one another by a rib, and extending along the longitudinal axis, wherein a second circuit of the at least two circuits includes a second fluid supply and distribution zone for supplying and distributing a second fluid from outside the stack, forming a second fluid pre-header, in which second pre-header channels are delimited by second studs distributed over a surface of each plate of the second circuit; and a second exchange zone continuous with the second pre-header and in which second exchange channels are each delimited by a groove, separated from one another by a rib, and extending along the longitudinal axis, and wherein the first studs of the first circuit and/or the second studs of the second circuit are holed and open-ended so as to allow communication between the first pre-header channels of the plates of the first circuit or the second pre-header circuit of the second circuit, but not with those of the plates of the second circuit or respectively of the first circuit.

2. The heat exchanger module according to claim 1, further comprising two first-circuit pre-headers each arranged at one end of longitudinal ends of the stack, one of the two pre-headers forming a fluid inlet pre-header, the other forming a fluid outlet pre-header.

3. The heat exchanger module according to claim 1, further comprising two second-circuit pre-headers each arranged at one end of longitudinal ends of the stack, one of the two pre-headers forming a fluid inlet pre-header, the other forming a fluid outlet pre-header.

4. The heat exchanger module according to claim 1, further comprising, at least at one end of longitudinal ends of the stack, a fluid header opening onto a lateral base plate of the stack onto which base plate the first pre-header channels of the first circuit pre-header open, but not those of the second circuit pre-header.

5. The heat exchanger module according to claim 4, further comprising, at one end of the longitudinal ends, a first fluid header forming the first circuit inlet header and, at the other end of the longitudinal ends, a second fluid header forming the first circuit outlet header.

6. The heat exchanger module according to claim 1, further comprising, at least on one lateral side of the stack, a fluid header passing through the stack transversely to the longitudinal axis and opening onto the second pre-header channels of the second fluid pre-header of the second circuit but not onto those of the first circuit.

7. The heat exchanger module according to claim 6, further comprising, at least on one same lateral side of the stack, a first fluid header forming a second circuit inlet header and a second fluid header forming a second circuit outlet header.

8. The heat exchanger module according to claim 1, wherein the first studs are uniformly distributed in a staggered configuration over the surface of the plate of the first fluid pre-header in a triangular pattern.

9. The heat exchanger module according to claim 1, wherein the first studs are uniformly distributed over the surface of the plate of the first fluid pre-header in a rectangular or square pattern.

10. The heat exchanger module according to claim 1, wherein the first and second studs are of cylindrical overall shape.

11. The heat exchanger module according to claim 1, wherein the first exchange channels of the first exchange zone of the first circuit and the second exchange channels of the second exchange zone of the second circuit are straight, mutually parallel, and extend parallel to the longitudinal axis.

12. The heat exchanger module according to claim, 1, wherein the stack is made up of metal plates assembled with one another either by hot isostatic pressing or by uniaxial hot pressing so as to obtain diffusion welding between the metal plates, or by brazing, or produced using additive manufacturing.

13. The heat exchanger module according to claim 1, wherein a plate of the first circuit is interposed between two plates of the second circuit at least in a central part of the stack.

14. A heat exchanger comprising a plurality of heat exchanger modules according to claim 1.

15. The heat exchanger according to claim 14, wherein the plurality of heat exchanger modules are arranged side by side with second circuit inlet and outlet headers passing through and laterally connecting the plurality of heat exchanger modules.

16. A method of using the heat exchanger according to claim 14, wherein the first fluid of the first circuit is a liquid metal and the second fluid of the second circuit is a gas or a gas mixture.

17. The method of using the exchanger according to claim 16, wherein the second fluid of the second circuit contains nitrogen and the first fluid of the first circuit is liquid sodium.

18. The method according to claim 16, wherein the first fluid of the first or of the second fluid comes from a nuclear reactor.

19. A nuclear facility, comprising:

a liquid metal fast neutron reactor, and a heat exchanger comprising a plurality of the exchanger modules according to claim 1.

* * * * *